US005616232A

United States Patent [19]

Nakazawa et al.

[11] Patent Number: 5,616,232

[45] Date of Patent: Apr. 1, 1997

[54] PROCESS FOR PRODUCING ZINC-CHROMIUM ALLOY-ELECTROPLATED STEEL PLATE

[75] Inventors: Makoto Nakazawa, Futtsu; Akira Takahashi, Kimitsu; Kenichiro Matsumura, Tokai, all of Japan

[73] Assignee: Nippon Steel Corporation, Tokyo, Japan

[21] Appl. No.: 534,144

[22] Filed: Sep. 26, 1995

[30] Foreign Application Priority Data

Sep. 28, 1994 [JP] Japan ..... 6-232685

[51] Int. Cl.[6] ..... C25D 3/56

[52] U.S. Cl. ..... 205/155; 205/156; 205/244; 205/243

[58] Field of Search ..... 205/243, 244, 205/245, 155, 156

[56] References Cited

U.S. PATENT DOCUMENTS

| | | | |
|---|---|---|---|
| 4,496,439 | 1/1985 | Greif et al. | 205/313 |
| 4,877,494 | 10/1989 | Kanamaru et al. | 205/244 |

FOREIGN PATENT DOCUMENTS

| | | |
|---|---|---|
| 63-243295 | 10/1988 | Japan . |
| 1-55398 | 3/1989 | Japan . |
| 1-191797 | 8/1989 | Japan . |
| 3-120393 | 5/1991 | Japan . |

*Primary Examiner*—Kathryn Gorgos
*Assistant Examiner*—Kishor Mayekar
*Attorney, Agent, or Firm*—Kenyon & Kenyon

[57] ABSTRACT

A process for producing a Zn—Cr alloy-electroplated steel plate, comprising immersing a steel plate in an acidic bath containing $Zn^{+2}$ ions and $Cr^{+3}$ ions and subjecting the steel plate to electroplating in the bath, wherein 0.01 g/–20 g/l of an additive comprising one or more members selected from the group consisting of polyethyleneoxyphenol derivatives with a sulfonic group (—$SO_3H$), sulfate group (—$SO_4H$), amino group (—$NH_2$), carboxyl group (—COOH), nitro group (—$NO_2$) or halogen (—F, —Cl, —Br or —I) as a substituent in the benzene ring, alkyl sulfonic acid compounds and polyethyleneoxyalkyl sulfonic acid compounds are added to the bath. The plating process makes it possible to produce Zn—Cr alloy-properties steel plates at a low cost without the additives having any adverse effect on the properties of the plating.

3 Claims, No Drawings

PROCESS FOR PRODUCING ZINC-CHROMIUM ALLOY-ELECTROPLATED STEEL PLATE

BACKGROUND OF THE INVENTION

1. Field of the Invention

The present intention relates to a process for producing a corrosion-resistant electroplated steel plate with excellent corrosion resistance for use in automobiles, electric appliances, building materials, etc. as well as excellent corrosion resistance after coating, and more specifically it relates to a process for producing a Zn—Cr alloy-electroplated steel plate.

2. Description of the Related Art

Methods for producing electroplated steel plates wherein chromium is included in zinc or zinc-based alloy platings are disclosed for example in Japanese Unexamined Patent Publication (Kokai) Nos. 63-243295, 1-191797 and 3-120393, according to which an organic additive is used in the plating bath to codeposit the chromium. The action mechanism of the additive is not fully understood, but the following two theories have been set forth.

A. The additive exhibits its codepositing effect by adsorbing onto the electrode surface.

B. The additive forms a complex with $Cr^{+3}$ ions, and the complex exhibits a codepositing effect.

In the case of theory A, the additive may be incorporated into the plated film during electrodeposition of the alloy, causing changes in the properties of the plating and deteriorating the adhesion of the plating. The concentration of the additive is consequently lowered, and it may be impossible to prepare an alloy with a consistent composition. In the case of theory B, a large amount of the additive is necessary to form the complex with the $Cr^{+3}$ ions, which is not suitable for economical production. Furthermore, a long time is required to form the complex when the $Cr^{+3}$ ion is supplied during continuous operation, and control of the plating bath is difficult.

No measures have yet been taken to solve the aforementioned problems involved with adding the additive to the plating bath.

As mentioned above, (a) the additive in the plating bath must contribute to the alloy electrodeposition without being incorporated into the plating during the electrodeposition, and must be returned to the bulk from the vicinity of the steel plate surface immediately after the alloy electrodeposition, (b) there must be a mechanism to prevent variation in the additive concentration before and after the electrodeposition, (c) the additive must be effective in small amounts, and (d) the control of the additive must be easy, requiring no pretreatment such as prior electrolysis, aging, etc. of the plating bath.

SUMMARY OF THE INVENTION

In light of these problems, the present invention provides a process for producing Zn—Cr alloy-electroplated steel plates using an additive which does not influence the properties of the plating, which is economical and advantageous in operation, which may be used immediately after preparation of the plating bath, and which may be easily controlled.

The present invention provides a process of producing a Zn—Cr alloy-electroplated steel plate, comprising immersing a steel plate in an acidic bath containing $Zn^{+2}$ ions and $Cr^{+3}$ ions and subjecting the steel plate to electroplating in the bath, wherein 0.01 g/l–20 g/l of an additive comprising one or more members selected from the group consisting of polyethyleneoxyphenol derivatives with a sulfonic group (—$SO_3H$), sulfate group (—$SO_4H$), amino group (—$NH_2$), carboxyl group (—COOH), nitro group (—$NO_2$) or halogen (—F, —Cl, —Br or —I) as a substituent in the benzene ring, alkyl sulfonic acid compounds and polyethyleneoxyalkyl sulfonic acid compounds are added to the bath.

DESCRIPTION OF THE PREFERRED EMBODIMENTS

According to the present invention, the polyethyleneoxyphenol derivative, alkyl sulfonic acid compound and polyethyleneoxyalkyl sulfonic acid compound added to the plating bath as additives may have the following structures, respectively.

| | |
|---|---|
| $O(CH_2CH_2O)_mH$ 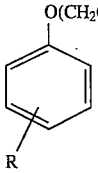 R | Polyethyleneoxyphenol derivative<br>m = 2–100 |
| R = $-SO_3H$, $-SO_4H$, $-NH_2$, $-COOH$, $-NO_2$, $-F$, $-Cl$, $-Br$ or $-I$ | |
| $CH_3(CH_2)_nSO_3H$ | Alkyl sulfonic acid compound<br>n = 5–19 |
| $CH_3-R_1-R_2-CH_2SO_3H$ | Polyethyleneoxyalkyl sulfonic acid compound |
| $R_1 = (CH_2)_a$<br>$R_2 = (CH_2CH_2O)_b$<br>or<br>$R_1 = (CH_2CH_2O)_c$<br>$R_2 = (CH_2)_d$ | a = 5–19<br>b = 2–100<br><br>c = 2–100<br>d = 5–19 |

These additives usable for the present invention are believed to form molecular aggregates known as micelles in aqueous solution. The hydrophilic groups are oriented toward the aqueous solution. The details of the structure of the molecular aggregates of the above-mentioned compounds are not fully understood, but the hydrophilic portion has a site which attaches to $Cr^{3+}$ions. The force of attraction here differs from the coordinate bonding for forming the complex in that it is a weak electrostatic bond, and therefore electrolysis of the $Cr^{3+}$ions occurs more readily, giving a higher current efficiency for the plating than hitherto achieved. The mechanism of electrodeposition of Zn and Cr is not yet fully understood, but is assumed to be as follows. That is, when the micelles with the attached $Cr^{3+}$ions approach the surface of the steel plate, the $Cr^{3+}$ions are deposited and the micelles, free from the metal ions, migrate back to the bulk. In the bulk, $Cr^{3+}$ions are again attached and the same process is repeated. Meanwhile, $Zn^{2+}$ions, which tend naturally to be electrodeposited, are deposited without the interaction with the additive. The deposited Cr and Zn are alloyed, becoming a Zn—Cr alloy.

The additive is not incorporated into the plated film with the alloy during electrodeposition. This is because, first of all, the additive does not have the mechanism of the alloy electrodeposition by which to adhere directly to the steel plate, and thus the micelles with the attached $Cr^{3+}$ions merely deposit them when they approach the vicinity of the steel plate surface. Also, since the size of the micelles is usually very large compared with the zinc and chromium atoms, it is inconceivable for the molecular aggregates to be incorporated into the plated film. Incidentally, the size of the micelles is not specified since it varies depending on the type, concentration, etc. of the additive.

The result is that the additive undergoes no reduction in concentration by incorporation into the film, and therefore the plating composition remains constant during continuous production and the propterties of the plating do not vary.

According to the present invention the polyethyleneoxyphenol derivatives with a substituent in the benzene ring are limited to those whose substituents are a sulfonic group (—$SO_3H$), sulfate group (—$SO_4H$), amino group (—$NH_2$), carboxyl group (—COOH), nitro group (—$NO_2$) or halogen (—F, —Cl, —Br or —I), for the following reason.

If the substituent is strongly hydrophobic, such as an alkyl group, micelles will not be formed and a suspension may result. This poses the risk of irregularities in the plating. Thus it is necessary that the substituent have a certain degree of hydrophilicity, and as a result of diligent research we have found that sulfonic groups (—$SO_3H$), sulfate groups (—$SO_4H$), amino groups (—$NH_2$), carboxyl groups (—COOH), nitro groups (—NO2) and halogens (—F, —Cl, —Br and —I) are preferable.

The substituent may form any type of salt so long as it does not increase the hydrophobicity as in the case of a sulfuric acid ester (—$SO_4R$, R=alkyl group). Examples to be used include sodium sulfonate (—$SO_3Na$), ammonium sulfonate (—$SO_3NH_4$), sodium sulfate (—$SO_3Na$), ammonium sulfate (—$SO_4NH_4$), amine hydrochloride (—$NH_3Cl$), sodium carboxylate (—COONa) and ammonium carboxylate (—$COONH_4$).

The additives mentioned above naturally exhibit their effect when used alone, and also 2 or more thereof may be used in admixture without impairing their mutual effects.

According to the present invention, control of the plating bath is relatively straight forward. In conventional Zn—Cr alloy electroplating baths, the structures of the $Cr^{3+}$complex include complexes with the additive, hydrated complexes and hydrated complexes including some anions, and since the hydrated complexes are in the form of mononuclear, binuclear and polynuclear complexes, the proportions vary depending on the standing temperature of the bath and the time. As a result, the composition of the plate obtained when the proportion of complexes in the bath is not constant has caused the problem of instability. However, since the present invention has a mechanism for electrodepositing Cr by making use of the phenomenon of $Cr^{3+}$ions attaching to micelles, it is possible to prepare a consistently constant alloy with the same composition regardless of the state of the $Cr^{3+}$ion.

The minimum required amount of the additive for formation of the micelles is a very small amount of 0.01 g/l, which is also suitable in terms of economical operation. Excessive addition leads to an increase in the viscosity of the solution and lower electrical conductivity, and in some cases there is a risk of a suspension resulting without dissolution of the additive, and therefore the amount is preferably no more than 20 g/l.

According to the present invention, a small amount (0.1 mol/l or less) of a metal ion such as $Ni^{2+}$, $Co^{2+}$, $Fe^{2+}$, $Mn^{2+}$or $Pb^{2+}$may be added to the plating bath if necessary for electrodeposition of a third component in the plated film.

The composition of the Zn—Cr alloy plating obtained according to the present invention may be varied by changing the composition of the plating bath and the current density. However, from the standpoint of corrosion resistance the Cr content is preferably 5 wt % or more, and it is preferably no more than 40 wt % since if the content exceeds this the plating becomes too powdery during working, leading to poor powdering properties. The plating bath may be either a sulfuric acid bath or a hydrochloric acid bath. The steel base to be plated is not specifically restricted, and there are no conditions on the method of producing the steel components or steel plate.

The present invention will now be explained by way of the following examples.

For Zn—Cr alloy-plating of a cold stretched steel plate with a plate thickness of 0.8 mm, a plating bath containing 0.6 mol/l of $Zn^{2+}$ion and 0.4 mol/l of $Cr^{3+}$ion with an acidity of pH 1.5 was used, with the plating being conducted at a bath temperature of 50° C. and a current density of 100 A/$dm^2$. The additives listed in Tables 1–6 were added to the plating bath at this time to obtain various Zn—Cr alloy-plated steel plates. The properties of the resultant plated steel plates were evaluated in terms of workability and corrosion resistance. Since codeposition of the additives in the Zn—Cr alloy-plated layer causing carbon contamination results in deterioration, the workability was determined as a measure of the presence or absence of additive codeposition. The evaluation was made based on the peeling of the plating at the bent sections upon adherence bending. The 3 levels of evaluation were ⊙ (no peeling), ○ (slight peeling) and ▲ (peeling). The results are shown in Tables 1–6. Also, the corrosion resistance of the plating was determined by measuring the proportion (%) of red rust produced during 1008 hours, using the salt spray test according to JIS2371, with a production of red rust of up to 20% evaluated as ○ and over 20% evaluated as x.

The ease of control of the plating bath was evaluated in terms of the stability of the resulting plating composition with time. That is, the difference between the plating composition obtained upon plating immediately after preparation of the plating bath and the plating composition obtained upon plating after aging at 50° C. for 48 hours was evaluated, with a difference of up to 1% denoted by ○, and over 1% denoted as x.

TABLE 1

| Exs. No. | Additive (g/l) | | Substituent | Wt % of chromium in plated film | Corrosion resistance | Workability | Stability with time |
|---|---|---|---|---|---|---|---|
| 1 | Polyethyleneoxyphenol derivative | 0.01 | Sulfonate group | 8 | ○ | ⊙ | ○ |
| 2 | Polyethyleneoxyphenol derivative | 0.10 | | 10 | ○ | ⊙ | ○ |
| 3 | Polyethyleneoxyphenol derivative | 0.50 | | 14 | ○ | ⊙ | ○ |

TABLE 1-continued

| Exs. No. | Additive (g/l) | | Substituent | Wt % of chromium in plated film | Corrosion resistance | Workability | Stability with time |
|---|---|---|---|---|---|---|---|
| 4 | Polyethyleneoxyphenol derivative | 1.00 | | 17 | ○ | ◎ | ○ |
| 5 | Polyethyleneoxyphenol derivative | 5.00 | | 24 | ○ | ◎ | ○ |
| 6 | Polyethyleneoxyphenol derivative | 10.00 | | 30 | ○ | ◎ | ○ |
| 7 | Polyethyleneoxyphenol derivative | 20.00 | | 34 | ○ | ◎ | ○ |
| 8 | Polyethyleneoxyphenol derivative | 0.01 | Sulfate group | 8 | ○ | ◎ | ○ |
| 9 | Polyethyleneoxyphenol derivative | 0.10 | | 11 | ○ | ◎ | ○ |
| 10 | Polyethyleneoxyphenol derivative | 0.50 | | 15 | ○ | ◎ | ○ |
| 11 | Polyethyleneoxyphenol derivative | 1.00 | | 19 | ○ | ◎ | ○ |
| 12 | Polyethyleneoxyphenol derivative | 10.00 | | 29 | ○ | ◎ | ○ |
| 13 | Polyethyleneoxyphenol derivative | 20.00 | | 32 | ○ | ◎ | ○ |
| 14 | Polyethyleneoxyphenol derivative | 0.01 | Amino group | 7 | ○ | ◎ | ○ |
| 15 | Polyethyleneoxyphenol derivative | 0.10 | | 10 | ○ | ◎ | ○ |
| 16 | Polyethyleneoxyphenol derivative | 0.50 | | 13 | ○ | ◎ | ○ |
| 17 | Polyethyleneoxyphenol derivative | 1.00 | | 18 | ○ | ◎ | ○ |
| 18 | Polyethyleneoxyphenol derivative | 10.00 | | 27 | ○ | ◎ | ○ |
| 19 | Polyethyleneoxyphenol derivative | 20.00 | | 30 | ○ | ◎ | ○ |
| 20 | Polyethyleneoxyphenol derivative | 0.01 | Carboxyl group | 7 | ○ | ◎ | ○ |
| 21 | Polyethyleneoxyphenol derivative | 0.10 | | 9 | ○ | ◎ | ○ |
| 22 | Polyethyleneoxyphenol derivative | 0.50 | | 12 | ○ | ◎ | ○ |
| 23 | Polyethyleneoxyphenol derivative | 1.00 | | 15 | ○ | ◎ | ○ |
| 24 | Polyethyleneoxyphenol derivative | 10.00 | | 21 | ○ | ◎ | ○ |
| 25 | Polyethyleneoxyphenol derivative | 20.00 | | 25 | ○ | ◎ | ○ |
| 26 | Polyethyleneoxyphenol derivative | 0.01 | Nitro group | 8 | ○ | ◎ | ○ |
| 27 | Polyethyleneoxyphenol derivative | 0.10 | | 11 | ○ | ◎ | ○ |
| 28 | Polyethyleneoxyphenol derivative | 0.50 | | 15 | ○ | ◎ | ○ |
| 29 | Polyethyleneoxyphenol derivative | 1.00 | | 19 | ○ | ◎ | ○ |
| 30 | Polyethyleneoxyphenol derivative | 10.00 | | 27 | ○ | ◎ | ○ |

TABLE 2

| Exs. No. | Additive g/l | | Substituent | Wt % of chromium in plated film | Corrosion resistance | Workability | Stability with time |
|---|---|---|---|---|---|---|---|
| 31 | Polyethyleneoxyphenol derivative | 20.00 | Nitro group | 31 | ○ | ◎ | ○ |
| 32 | Polyethyleneoxyphenol derivative | 0.01 | —Cl | 6 | ○ | ◎ | ○ |
| 33 | Polyethyleneoxyphenol derivative | 0.10 | | 8 | ○ | ◎ | ○ |
| 34 | Polyethyleneoxyphenol derivative | 0.50 | | 11 | ○ | ◎ | ○ |

TABLE 2-continued

| Exs. No. | Additive g/l | | Substituent | Wt % of chromium in plated film | Corrosion resistance | Workability | Stability with time |
|---|---|---|---|---|---|---|---|
| 35 | Polyethyleneoxyphenol derivative | 1.00 | | 14 | ○ | ◎ | ○ |
| 36 | Polyethyleneoxyphenol derivative | 10.00 | | 23 | ○ | ◎ | ○ |
| 37 | Polyethyleneoxyphenol derivative | 20.00 | —Br | 27 | ○ | ◎ | ○ |
| 38 | Alkyl sulfonic acid | 0.01 | | 6 | ○ | ◎ | ○ |
| 39 | Alkyl sulfonic acid | 0.10 | | 8 | ○ | ◎ | ○ |
| 40 | Alkyl sulfonic acid | 0.50 | | 9 | ○ | ◎ | ○ |
| 41 | Alkyl sulfonic acid | 1.00 | | 12 | ○ | ◎ | ○ |
| 42 | Alkyl sulfonic acid | 10.00 | | 16 | ○ | ◎ | ○ |
| 43 | Alkyl sulfonic acid | 20.00 | | 21 | ○ | ◎ | ○ |
| 44 | Polyethyleneoxyalkyl sulfonic acid | 0.01 | | 11 | ○ | ◎ | ○ |
| 45 | Polyethyleneoxyalkyl sulfonic acid | 0.10 | | 16 | ○ | ◎ | ○ |
| 46 | Polyethyleneoxyalkyl sulfonic acid | 0.50 | | 20 | ○ | ◎ | ○ |
| 47 | Polyethyleneoxyalkyl sulfonic acid | 1.00 | | 27 | ○ | ◎ | ○ |
| 48 | Polyethyleneoxyalkyl sulfonic acid | 10.00 | | 31 | ○ | ◎ | ○ |
| 49 | Polyethyleneoxyalkyl sulfonic acid | 20.00 | | 34 | ○ | ◎ | ○ |
| 50 | Polyethyleneoxyphenol derivative | 0.01 | Sulfonate group | 9 | ○ | ◎ | ○ |
| | Alkyl sulfonic acid | 0.01 | | | | | |
| 51 | Polyethyleneoxyphenol derivative | 0.01 | | 9 | ○ | ◎ | ○ |
| | Polyethyleneoxyalkyl sulfonic acid | 0.01 | | | | | |
| 52 | Polyethyleneoxyphenol derivative | 0.10 | | 12 | ○ | ◎ | ○ |
| | Alkyl sulfonic acid | 0.01 | | | | | |
| 53 | Polyethyleneoxyphenol derivative | 0.10 | | 11 | ○ | ◎ | ○ |
| | Polyethyleneoxyalkyl sulfonic acid | 0.01 | | | | | |
| 54 | Polyethyleneoxyphenol derivative | 0.10 | | 11 | ○ | ◎ | ○ |
| | Alkyl sulfonic acid | 1.00 | | | | | |
| 55 | Polyethyleneoxyphenol derivative | 0.10 | | 22 | ○ | ◎ | ○ |
| | Polyethyleneoxyalkyl sulfonic acid | 1.00 | | | | | |

TABLE 3

| Exs. No. | Additive (g/l) | | Substituent | Wt % of chromium in plated film | Corrosion resistance | Workability | Stability with time |
|---|---|---|---|---|---|---|---|
| 56 | Polyethyleneoxyphenol derivative | 0.50 | Sulfonate group | 12 | ○ | ◎ | ○ |
| | Alkyl sulfonic acid | 0.01 | | | | | |
| 57 | Polyethyleneoxyphenol derivative | 0.50 | | 16 | ○ | ◎ | ○ |
| | Polyethyleneoxyalkyl sulfonic acid | 0.01 | | | | | |
| 58 | Polyethyleneoxyphenol derivative | 1.00 | | 17 | ○ | ◎ | ○ |
| | Alkyl sulfonic acid | 0.01 | | | | | |
| 59 | Polyethyleneoxyphenol derivative | 1.00 | | 19 | ○ | ◎ | ○ |
| | Polyethyleneoxyalkyl sulfonic acid | 0.01 | | | | | |
| 60 | Polyethyleneoxyphenol derivative | 10.00 | | 28 | ○ | ◎ | ○ |
| | Alkyl sulfonic acid | 0.01 | | | | | |

TABLE 3-continued

| Exs. No. | Additive (g/l) | | Substituent | Wt % of chromium in plated film | Corrosion resistance | Workability | Stability with time |
|---|---|---|---|---|---|---|---|
| 61 | Polyethyleneoxyphenol derivative | 10.00 | | 32 | ○ | ◎ | ○ |
| | Polyethyleneoxyalkyl sulfonic acid | 0.01 | | | | | |
| 62 | Polyethyleneoxyphenol derivative | 0.10 | Sulfate group | 10 | ○ | ◎ | ○ |
| | Alkyl sulfonic acid | 0.01 | | | | | |
| 63 | Polyethyleneoxyphenol derivative | 0.10 | | 12 | ○ | ◎ | ○ |
| | Polyethyleneoxyalkyl sulfonic acid | 0.01 | | | | | |
| 64 | Polyethyleneoxyphenol derivative | 1.00 | | 18 | ○ | ◎ | ○ |
| | Alkyl sulfonic acid | 0.01 | | | | | |
| 65 | Polyethyleneoxyphenol derivative | 1.00 | | 20 | ○ | ◎ | ○ |
| | Polyethyleneoxyalkyl sulfonic acid | 0.01 | | | | | |
| 66 | Polyethyleneoxyphenol derivative | 10.00 | | 27 | ○ | ◎ | ○ |
| | Alkyl sulfonic acid | 0.01 | | | | | |
| 67 | Polyethyleneoxyphenol derivative | 10.00 | | 33 | ○ | ◎ | ○ |
| | Polyethyleneoxyalkyl sulfonic acid | 0.01 | | | | | |
| 68 | Polyethyleneoxyphenol derivative | 0.01 | Amino group | 7 | ○ | ◎ | ○ |
| | Alkyl sulfonic acid | 0.01 | | | | | |
| 69 | Polyethyleneoxyphenol derivative | 0.01 | | 9 | ○ | ◎ | ○ |
| | Polyethyleneoxyalkyl sulfonic acid | 1.01 | | | | | |
| 70 | Polyethyleneoxyphenol derivative | 0.50 | Nitro group | 14 | ○ | ◎ | ○ |
| | Alkyl sulfonic acid | 0.01 | | | | | |

TABLE 4

| Exs. No. | Additive (g/l) | | Substituent | Wt % of chromium in plated film | Corrosion resistance | Workability | Stability with time |
|---|---|---|---|---|---|---|---|
| 71 | Polyethyleneoxyphenol derivative | 0.50 | Nitro group | 15 | ○ | ◎ | ○ |
| | Polyethyleneoxyalkyl sulfonic acid | 0.01 | | | | | |
| 72 | Polyethyleneoxyphenol derivative | 1.00 | | 18 | ○ | ◎ | ○ |
| | Alkyl sulfonic acid | 0.01 | | | | | |
| 73 | Polyethyleneoxyphenol derivative | 1.00 | | 21 | ○ | ◎ | ○ |
| | Polyethyleneoxyalkyl sulfonic acid | 0.01 | | | | | |
| 74 | Polyethyleneoxyphenol derivative | 10.00 | | 25 | ○ | ◎ | ○ |
| | Alkyl sulfonic acid | 0.01 | | | | | |
| 75 | Polyethyleneoxyphenol derivative | 10.00 | | 29 | ○ | ◎ | ○ |
| | Polyethyleneoxyalkyl sulfonic acid | 0.01 | | | | | |
| 76 | Polyethyleneoxyphenol derivative | 0.01 | Carboxyl group | 8 | ○ | ◎ | ○ |
| | Alkyl sulfonic acid | 0.01 | | | | | |
| 77 | Polyethyleneoxyphenol derivative | 0.01 | | 8 | ○ | ◎ | ○ |
| | Polyethyleneoxyalkyl | 0.01 | | | | | |

TABLE 4-continued

| Exs. No. | Additive (g/l) | | Substituent | Wt % of chromium in plated film | Corrosion resistance | Workability | Stability with time |
|---|---|---|---|---|---|---|---|
| | sulfonic acid | | | | | | |
| 78 | Polyethyleneoxyphenol derivative | 0.50 | | 13 | ○ | ◎ | ○ |
| | Alkyl sulfonic acid | 0.01 | | | | | |
| 79 | Polyethyleneoxyphenol derivative | 0.50 | | 16 | ○ | ◎ | ○ |
| | Polyethyleneoxyalkyl sulfonic acid | 0.01 | | | | | |
| 80 | Polyethyleneoxyphenol derivative | 1.00 | | 17 | ○ | ◎ | ○ |
| | Alkyl sulfonic acid | 0.01 | | | | | |
| 81 | Polyethyleneoxyphenol derivative | 1.00 | | 19 | ○ | ◎ | ○ |
| | Polyethyleneoxyalkyl sulfonic acid | 0.01 | | | | | |
| 82 | Polyethyleneoxyphenol derivative | 10.00 | | 22 | ○ | ◎ | ○ |
| | Alkyl sulfonic acid | 0.01 | | | | | |
| 83 | Polyethyleneoxyphenol derivative | 10.00 | | 25 | ○ | ◎ | ○ |
| | Polyethyleneoxyalkyl sulfonic acid | 0.01 | | | | | |

TABLE 5

| Comp. Exs. No. | Additive (g/l) | | Substituent | Wt % of chromium in plated film | Corrosion resistance | Workability | Stability with time |
|---|---|---|---|---|---|---|---|
| 1 | Polyethyleneoxyphenol derivative | 0.001 | Sulfonate group | 2 | x | ◎ | ○ |
| 2 | Polyethyleneoxyphenol derivative | 0.001 | Sulfate group | 2 | x | ◎ | ○ |
| 3 | Polyethyleneoxyphenol derivative | 0.001 | Amino group | 1 | x | ○ | ○ |
| 4 | Polyethyleneoxyphenol derivative | 0.001 | Carboxyl group | 0 | x | ○ | ○ |
| 5 | Polyethyleneoxyphenol derivative | 0.001 | Nitro group | 1 | x | ◎ | ○ |
| 6 | Polyethyleneoxyphenol derivative | 0.001 | —Cl | 0 | x | ○ | ○ |
| 7 | Alkyl sulfonic acid | 0.001 | | 0 | x | ○ | ○ |
| 8 | Polyethyleneoxyalkyl sulfonic acid | 0.001 | | 2 | x | ○ | ○ |
| 9 | Polyethyleneoxyphenol derivative | 0.001 | Sulfate group | 1 | x | ○ | ○ |
| | Alkyl sulfonic acid | 0.001 | | | | | |
| 10 | Polyethyleneoxyphenol derivative | 0.001 | Amino group | 0 | x | ○ | ○ |
| | Alkyl sulfonic acid | 0.001 | | | | | |
| 11 | Polyethyleneoxyphenol derivative | 0.001 | Carboxyl group | 0 | x | ○ | ○ |
| | Alkyl sulfonic acid | 0.001 | | | | | |
| 12 | Polyethyleneoxyphenol derivative | 0.001 | Nitro group | 1 | x | ○ | ○ |
| | Alkyl sulfonic acid | 0.001 | | | | | |
| 13 | Polyethyleneoxyphenol derivative | 0.001 | —Cl | 0 | x | ○ | ○ |
| | Alkyl sulfonic acid | 0.001 | | | | | |
| 14 | Polyethyleneoxyphenol derivative | 0.001 | Sulfonate group | 0 | x | ○ | ○ |
| | Polyethyleneoxyalkyl sulfonic acid | 0.001 | | | | | |

TABLE 6

| Comp. Exs. No. | Additive (g/l) | | Substituent | Wt % of chromium in plated film | Corrosion resistance | Workability | Stability with time |
|---|---|---|---|---|---|---|---|
| 15 | Polyethyleneoxyphenol derivative | 0.001 | Sulfate group | 1 | x | o | o |
| | Polyethyleneoxyalkyl sulfonic acid | 0.001 | | | | | |
| 16 | Polyethyleneoxyphenol derivative | 0.001 | Amino group | 1 | x | o | o |
| | Polyethyleneoxyalkyl sulfonic acid | 0.001 | | | | | |
| 17 | Polyethyleneoxyphenol derivative | 0.001 | Carboxyl group | 0 | x | o | o |
| | Polyethyleneoxyalkyl sulfonic acid | 0.001 | | | | | |
| 18 | Polyethyleneoxyphenol derivative | 0.001 | Nitro group | 0 | x | o | o |
| | Polyethyleneoxyalkyl sulfonic acid | 0.001 | | | | | |
| 19 | Polyethyleneoxyphenol derivative | 0.001 | —Br | 0 | x | o | o |
| | Polyethyleneoxyalkyl sulfonic acid | 0.001 | | | | | |
| 20 | Polyethyleneoxyalkyl sulfonic acid | 0.001 | | 0 | x | o | o |
| | Alkyl sulfonic acid | 0.001 | | | | | |
| 21 | Polyethyleneoxyphenol derivative | 0.001 | Sulfonate group | 0 | x | o | o |
| | Polyethyleneoxyalkyl sulfonic acid | 0.001 | | | | | |
| | Alkyl sulfonic acid | 0.001 | | | | | |
| 22 | Tartaric acid | 4 | | 0.01 | x | o | x |
| 23 | Tartaric acid | 10 | | 7 | o | x | x |
| 24 | Malic acid | 4 | | 0.1 | x | o | x |
| 25 | Malic acid | 9 | | 5 | o | x | x |

In Examples 1–83, specific Zn—Cr alloys with a Cr wt % of the plated film of up to 6%–34% were obtained. Also, the corrosion resistances and plating adhesions were excellent. The stability of the plating compositions with time were also excellent.

On the other hand, as shown by the Comparative Examples 1–21, with only trace amounts of the additives, almost no chromium was deposited in the plating films, and therefore these do exhibit satisfactory corrosion resistance; however, as shown by the Comparative Examples 22–25, when only small amounts of the additives that form complexes with $Cr^{3+}$ions are added, chromium is not deposited in the plating layer and thus the corrosion resistance is poor, whereas with larger amounts of the additive, chromium is deposited with improvement in the corrosion resistance but the workability is impaired. The stability of the plating composition with time is also poor.

As is clear from the above explanation, in the process of the present invention, the additive has no adverse effect whatsoever on the properties of the plating, and therefore Zn—Cr alloy-electroplating may be performed at a low cost; the process is therefore suitable for the production of Zn—Cr alloy-electroplatings.

We claim:

1. A process for producing a Zn—Cr alloy-electroplated steel plate, comprising immersing a steel plate in an acidic bath containing $Zn^{+2}$ ions and $Cr^{+3}$ ions and subjecting the steel plate to electroplating in the bath to from a Zn—Cr alloy-electroplated steel plate, wherein 0.01 g/l–20 g/l of an additive comprising a polyethyleneoxyphenol derivative with at least one of a sulfonic group (—$SO_3H$), sulfate group (—$SO_4H$), amino group (—$NH_2$), carboxyl group (—COOH), nitro group (—$NO_2$) or halogen (—F, —Cl, —Br or —I) as a substituent in the benzene ring is added to the bath to accelerate the Cr Codeposition and to improve the stability of the bath.

2. A process according to claim 1, wherein the polyethyleneoxyphenol derivative is selected from the compounds represented by the following formula

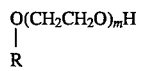

wherein R is —$SO_3H$, —$SO_4H$, $NH_2$, —COOH, —$NO_2$, —F, —Cl, —Br, or —I, and m is an integer of 1 to 100.

3. A process according to claim 1, wherein the Zn—Cr alloy of the electroplated steel plate has a Cr content of 5 to 40% by weight.

* * * * *

UNITED STATES PATENT AND TRADEMARK OFFICE

CERTIFICATE OF CORRECTION

PATENT NO. : 5,616,232

DATED : April 1, 1997

INVENTOR(S) : Makoto NAKAZAWA, et al.

It is certified that error appears in the above-indentified patent and that said Letters Patent is hereby corrected as shown below:

Column 3, line 21, change "(--NO2)" to --(--$NO_2$)--.

Column 3, line 36, change "straight forward" to --straightforward--.

Column 14, line 48, change "Codeposition" to --codeposition--.

Signed and Sealed this

Twenty-third Day of September, 1997

*Attest:*

*Attesting Officer*

BRUCE LEHMAN

*Commissioner of Patents and Trademarks*